US006089949A

United States Patent [19]

Resper et al.

[11] Patent Number: 6,089,949

[45] Date of Patent: Jul. 18, 2000

[54] SEGMENTAL DOLL

[76] Inventors: Vanessa Resper, 2615 Pine Lake Dr., Greensboro, N.C. 27407; Sybil Resper, 5723 Wildberry Dr.; Cynthia Resper Sharpe, 4238 United St., Apt. E, both of Greensboro, N.C. 27409

[21] Appl. No.: 09/145,957

[22] Filed: Sep. 3, 1998

[51] Int. Cl.[7] ..... A63H 3/04; A63H 3/02

[52] U.S. Cl. ..... 446/369; 446/374

[58] Field of Search ..... 446/369, 370, 446/371, 268, 385, 388, 387, 374, 373

[56] References Cited

U.S. PATENT DOCUMENTS

| | | | |
|---|---|---|---|
| 2,535,818 | 12/1950 | Smalley | 446/370 |
| 2,812,616 | 11/1957 | Ford | 446/374 |
| 3,552,057 | 1/1971 | Laillevault | 446/374 |
| 4,197,670 | 4/1980 | Cox | 446/369 |
| 4,816,001 | 3/1989 | Narvaez et al. | 446/370 |
| 4,884,991 | 12/1989 | Terzian | 446/369 |
| 4,921,460 | 5/1990 | Lin | 446/385 |
| 5,015,209 | 5/1991 | Ortiz | 446/369 X |
| 5,713,781 | 2/1998 | Castanis | 446/369 |
| 5,807,155 | 9/1998 | Divvleeon | 446/369 X |

FOREIGN PATENT DOCUMENTS

| | | | |
|---|---|---|---|
| 18419 | of 1889 | United Kingdom | 446/268 |

*Primary Examiner*—D. Neal Muir
*Attorney, Agent, or Firm*—Rhodes & Mason, PLLC

[57] ABSTRACT

This invention relates to soft dolls and animals formed of groups of stuffed segments on flexible cores. The torso, arms and legs of the doll are formed by different groups of stuffed segments on flexible cores. The segments in each group are sewn together and segments of the torso are sewn to segments in the arms and legs. A head is attached to the torso.

5 Claims, 5 Drawing Sheets

SEGMENTAL DOLL

FIELD OF THE INVENTION

This invention relates to dolls and more specifically to soft dolls with a torso and limbs each formed of a series of segments resembling doughnuts.

BACKGROUND OF THE INVENTION

Soft dolls having a torso, arms and legs, each defined by a continuous stuffing or filling with rags, cotton batting, foam, or a particulate filler such as beans are known in the art. See, for example, U.S. Pat. No. 4,884,991 to Terzian, issued Dec. 5, 1989 for POSEABLE SOFT DOLL, and the prior art cited therein.

None of the prior art known to applicants teaches or suggests a soft doll wherein the torso and each arm and leg are formed of a series of interconnected fabric segments on a flexible core.

SUMMARY OF THE INVENTION

The torso of the doll is made from a series of segments joined together on a flexible core, and each arm and each leg is made from a series of segments joined together on a flexible core. Every segment is a closed pouch stuffed with fiberfil or other suitable stuffing material. Each of the body parts formed in this fashion resembles a stack of doughnuts.

DETAILED DESCRIPTION OF THE INVENTION

Figure 1:
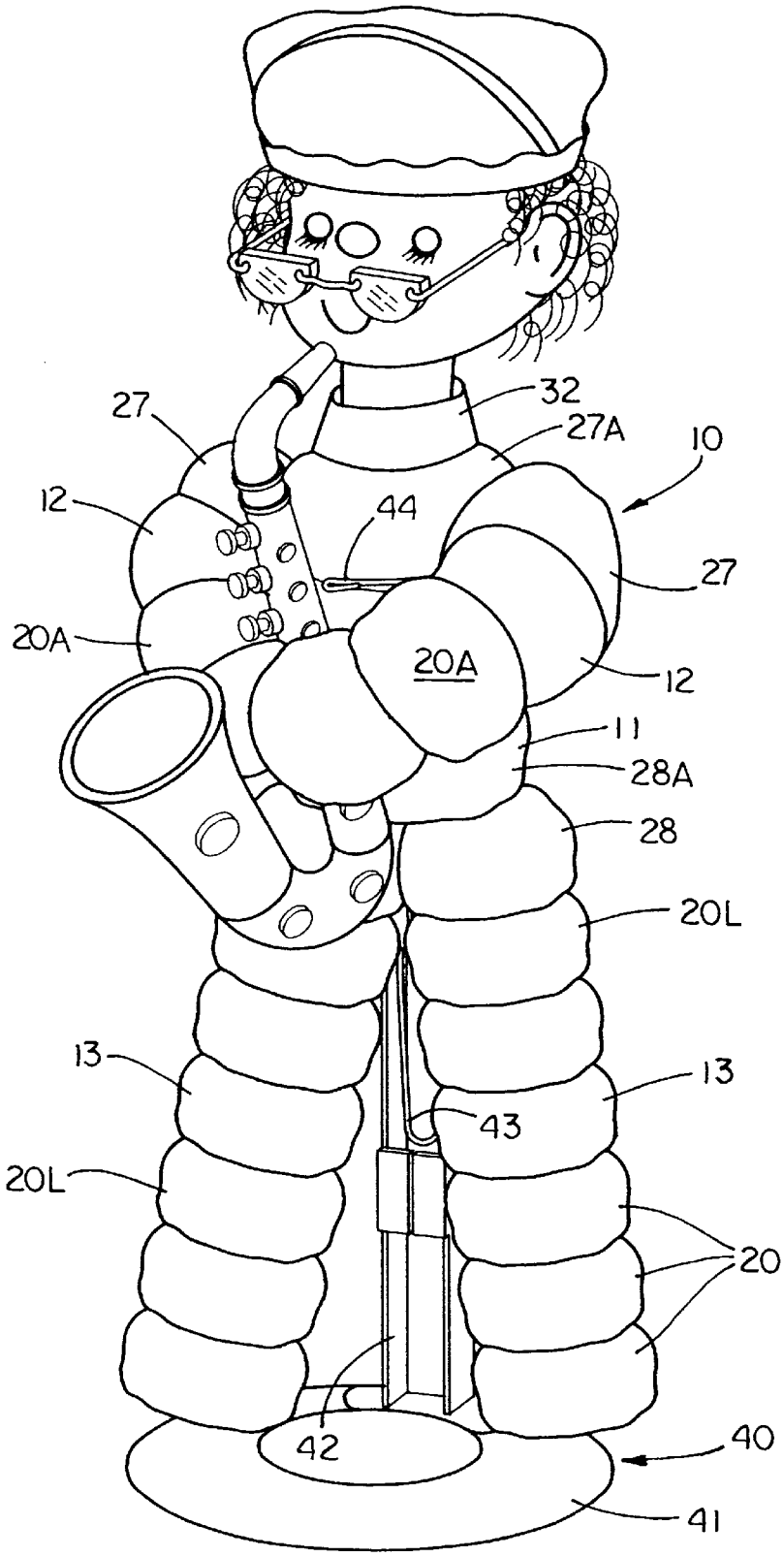
FIG. 1 is a perspective view of one embodiment of the segmental doll, supported on a prior art stand.

A segmental doll 10 has a torso 11, a pair of arms 12 and a pair of legs 13, collectively called body parts 14. Each of the body parts 14 is formed from a plurality of segments 20.

Figure 4:
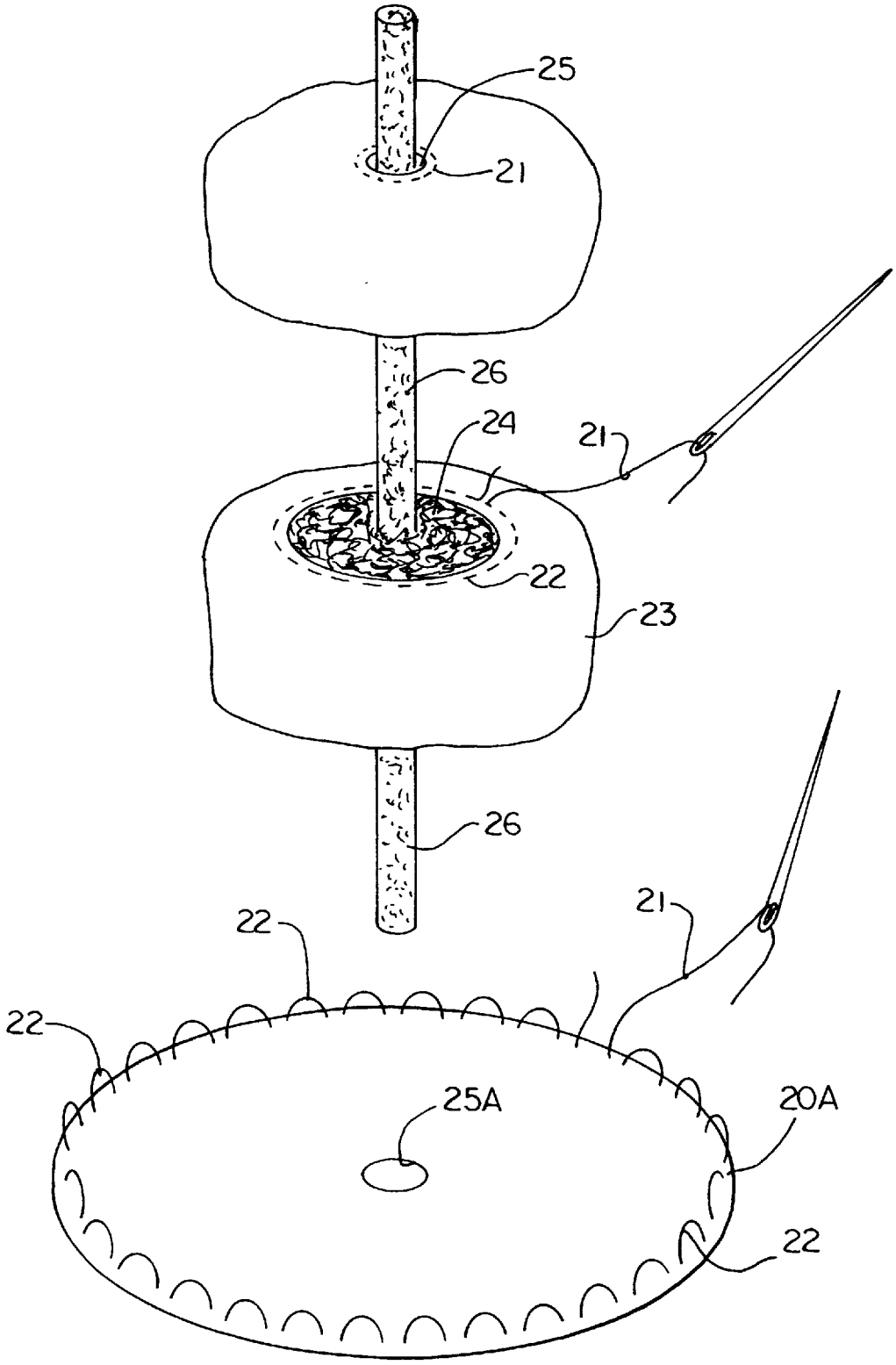
FIG. 4 is an exploded perspective view illustrating the making of the segments and the mounting of the segments on a flexible core.
Figure 5:
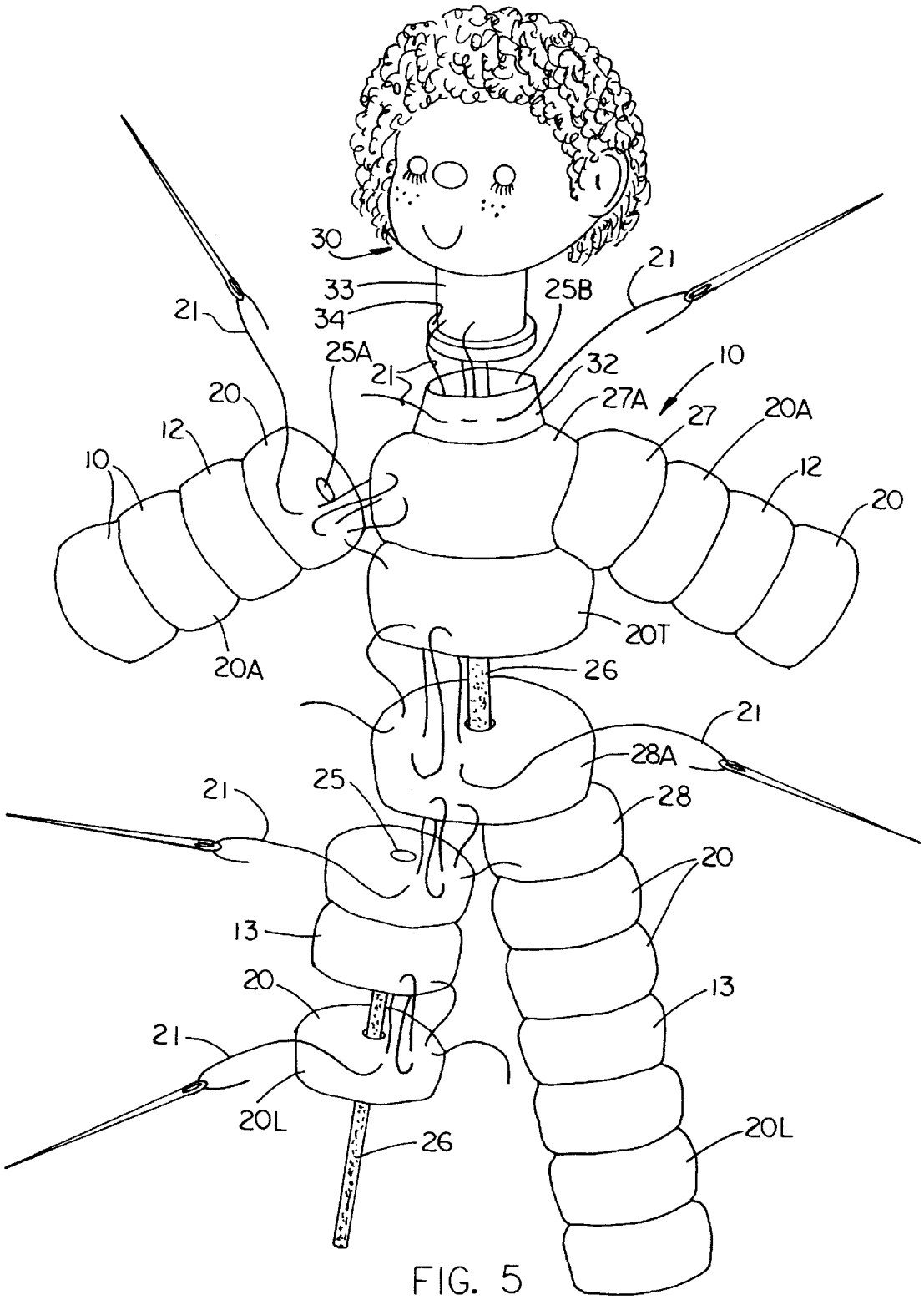
FIG. 5 is a perspective view illustrating the assembly of segments to make the doll of FIG. 1.

Each segment 20 is made by cutting cloth, which may be either woven or knitted, into a circle, indicated at 20A in FIG. 4. The circle 20A for each segment 20 has a desired diameter, such as six, eleven or eighteen inches. Each circular piece of cloth 20A is stitched with a thread 21 to form a circular arrangement of gatherings 22, which are loose loops of stitching, spaced approximately one quarter of an inch inwardly from the circumference of the circular cloth 20A. After the circular arrangement of gatherings is formed, the thread 21 is tensioned to form an open-topped pouch 23 (FIG. 4). The pouch 23 is filled with a suitable stuffing 24, such as polyfil. The tension on the thread 21 is then increased to substantially close the pouch 23, leaving an opening 25 of approximately ¼ of an inch in the midst of the stitching 25 that formed the circular arrangement of gatherings 22. Each pouch 23 is, or has been, cut on the side opposite the opening 25 to form another opening 25A (FIGS. 4 and 5). That completes the segment 20.

The two openings 25 and 25A are of approximately the same size, and receive a flexible core 26, such as a pipe cleaner. Each of the body parts 14 has a separate core 26, and is formed by passing a core 26 through successive segments 20 and then stitching those segments together with the thread 21. Thus, segments 20T form the torso 11; segments 20A form the arms 12; and segments 20L form the legs 13.

The body parts 14 are united by stitching together the uppermost segments 27 in the arms 12 with an upper segment 27A in the torso 11 and stitching together the upper segments 28 in the legs 13 with the lowermost segment 28A in the torso 11.

The segmental doll 10 is completed with a head 30 and feet 31. The head 30 is made of cloth, plastic or porcelain in a conventional manner and attached to the uppermost segment 32, which forms the neck of the torso 11. The segment 32 does not include stuffing 24 and further differs from the segments 20 by having a larger opening 25B in its upper part to receive the neck 33 extending downwardly from the head 30. The neck 33 terminates beneath the head 30 in an annular ring 34 that is enclosed in the segment 32. Stitching 21 connects the segment 32 to the torso segment 27A and to the doll's neck 33 (FIG. 5). In the illustrated embodiment, the hands of the doll are obscured by clothing as in FIG. 2, or obscured by something the doll is holding, as in FIG. 1. The feet may be made of the segments 20, but without the opening 25A, or may be specially made segments 20F, as in FIG. 2. Plastic hands and feet may by used within the spirit and scope of the invention.

Figure 2:
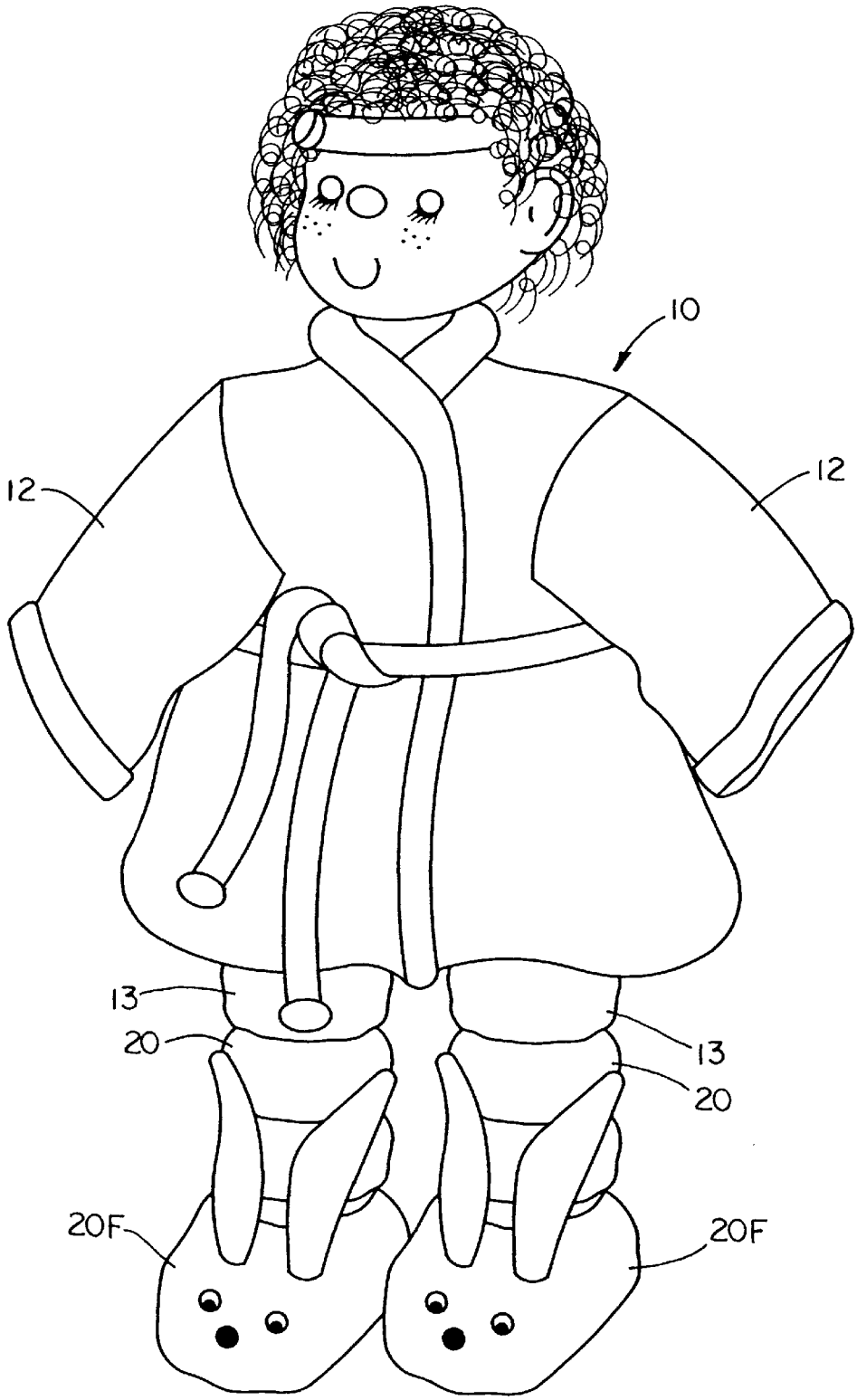
FIG. 2 is a perspective view of a second embodiment of the segmental doll.
Figure 3:
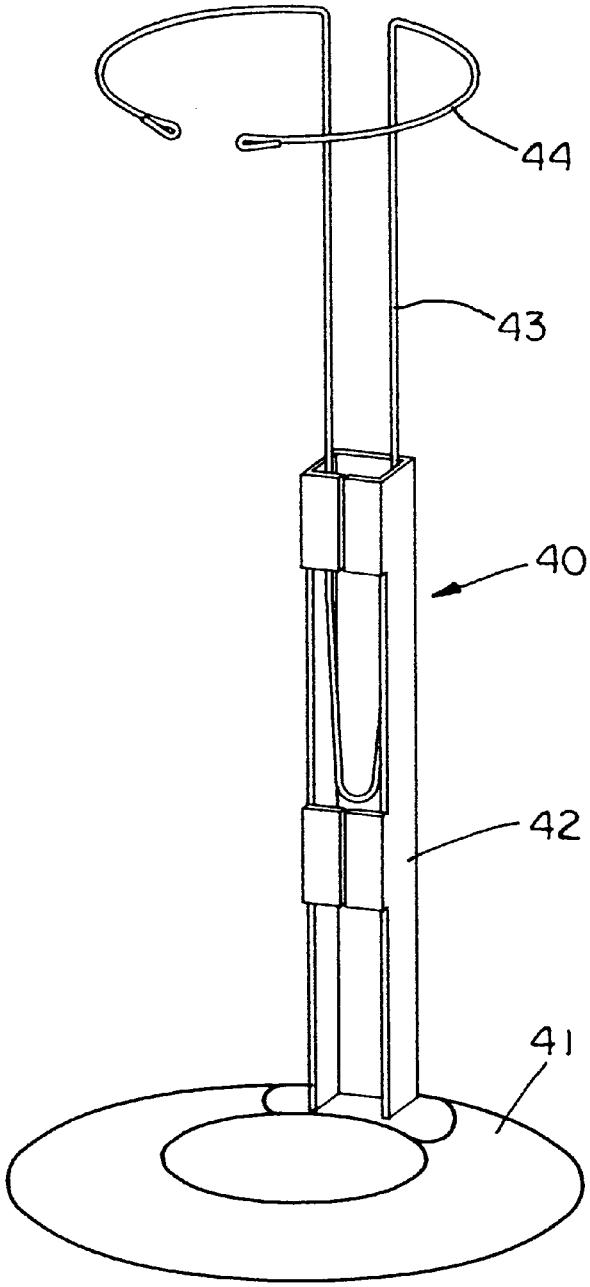
FIG. 3 PRIOR ART
FIG. 3 is a perspective view of the prior art stand shown in FIG. 1.

The segmental doll may be supported in a standing position, as in FIG. 1, by attaching the doll to a rack 40 (FIGS. 1 and 3). The structure of the rack is not part of the invention, but use of a telescopic rack that can be adjusted for use with dolls of different heights is recommended. The prior art rack 40 in FIGS. 1 and 3 comprises a base 41, a vertical support 42, a telescopic support member 43 and an encircling clamp 44 that extends around the torso of the doll, as in FIG. 1.

There is thus provided a segmental doll with flexible cores in its body parts enabling the doll to be displayed and supported in a variety of positions. The doll can be clothed in different garments and support different objects, such as the saxophone illustrated in FIG. 1.

We claim:

1. A doll having a head and body parts defined by a torso, two arms and two legs, wherein each body part is defined by a plurality of individual segments and a flexible core, the flexible core extending loosely through the segments and the segments in each body part being connected to each other and segments in the torso being connected to segments in the arms and legs, each segment comprising a stuffed pouch formed from a circular piece of cloth and stuffing in the shape of a doughnut, and the pouch having opposed openings to receive a flexible core.

2. The invention of claim 1 wherein the stuffing is polyfil.

3. The invention of claim 1 wherein each of the body parts resembles a stack of doughnuts.

4. The invention of claim 1 wherein the flexible core is a pipe cleaner.

5. The method of making a doll having a head and body parts defined by a torso, two arms and two legs, said method comprising the following steps:

(a) providing a supply of cloth;

(b) cutting the cloth into circles of a desired diameter;

(c) cutting a hole in the center of each circle of cloth;

(d) forming a circular arrangement of gatherings with loose stitches of thread spaced inwardly from the circumference of each circle of cloth;

(e) tensioning the thread in each circle of cloth to form an open-top pouch from each circle of cloth;

(f) providing a supply of stuffing;

(g) placing a desired amount of stuffing in each pouch;

(g) defining segments of the doll by further tensioning the thread in each pouch to define a hole corresponding in size to the hole cut in the center of its circle of cloth;

(h) providing a supply of flexible cores;

(i) passing a first flexible core through a first group of segments and sewing the first group of segments together to form the torso of the doll;

(j) passing a second flexible core through a second group of segments and sewing the second group of segments together to form one arm of the doll;

(k) passing a third flexible core through a third group of segments and sewing the third group of segments together to form the other arm of the doll;

(l) passing a fourth flexible core through a fourth group of segments and sewing the fourth group of segments together to form one leg of the doll;

(m) passing a fifth flexible core through a fifth group of segments and sewing the fifth group of segments together to form the other leg of the doll;

(n) providing a head for the doll; and (o) attaching the head to the torso.

* * * * *